United States Patent [19]

Tsukano

[11] Patent Number: 4,625,895

[45] Date of Patent: Dec. 2, 1986

[54] DRY-PROCESS DEVELOPER REPLACING AND SUPPLYING DEVICE FOR ELECTROPHOTOGRAPHIC RECORDING APPARATUS

[75] Inventor: Moriyoshi Tsukano, Kawasaki, Japan

[73] Assignee: Ricoh Company, Ltd., Tokyo, Japan

[21] Appl. No.: 691,888

[22] Filed: Jan. 16, 1985

[30] Foreign Application Priority Data

Jan. 20, 1984 [JP] Japan ..... 59-6089[U]
Jan. 20, 1984 [JP] Japan ..... 59-6090[U]

[51] Int. Cl.[4] ..... G03G 15/08; B65B 1/06

[52] U.S. Cl. ..... 222/63; 222/325; 222/485; 222/559; 222/DIG. 1; 355/3 DD; 141/311 R; 118/653; 118/663

[58] Field of Search ..... 222/DIG. 1, 485, 361, 222/325, 52, 56, 57, 63, 559; 355/3 DD; 118/653, 655, 656, 657, 658, 663, 688; 141/311 R, 363, 364, 365, 366

[56] References Cited

U.S. PATENT DOCUMENTS

| | | | |
|---|---|---|---|
| 3,339,807 | 9/1967 | Eichorn | 222/DIG. 1 X |
| 3,356,248 | 12/1967 | Del Vecchio | 222/DIG. 1 X |
| 3,618,826 | 11/1971 | Kangas et al. | 222/DIG. 1 X |
| 4,089,601 | 5/1978 | Navone | 222/DIG. 1 X |
| 4,370,053 | 1/1983 | Hirayama et al. | 222/DIG. 1 X |
| 4,391,503 | 7/1983 | Pugh | 355/3 DD |
| 4,435,065 | 3/1984 | Wada | 118/653 X |
| 4,439,034 | 3/1984 | Daniels | 355/3 DD |
| 4,441,636 | 4/1984 | Yamashita et al. | 222/DIG. 1 X |
| 4,451,133 | 5/1984 | Kopp et al. | 355/3 DD |
| 4,456,154 | 6/1984 | Herriman | 222/DIG. 1 |
| 4,523,615 | 6/1985 | Feenstra et al. | 355/3 DD X |

FOREIGN PATENT DOCUMENTS

| | | | |
|---|---|---|---|
| 0168670 | 12/1981 | Japan | 118/658 |

*Primary Examiner*—Joseph J. Rolla
*Assistant Examiner*—Edward S. Ammeen
*Attorney, Agent, or Firm*—Oblon, Fisher, Spivak, McClelland & Maier

[57] ABSTRACT

A developer replacing and supplying device for a small-size electrophotographic copier is disclosed which removes used developer from a developing unit and supplies a fresh developer instead. After the used developer which is a mixture of carrier and toner has been discharged, fresh carrier is introduced into the developing unit and, then, fresh toner to be mixed with the fresh carrier. The fresh carrier and the fresh toner are stored in physically independent cylindrical cartridges, which are selectively mounted in a cartridge casing. The cartridge casing is mounted in a hopper casing, which is provided integrally with the developing unit, and driven in a rotational motion together with the cartridge. The supply of the toner or the carrier from the associated cartridge into the developing unit is selectively intercepted by an interceptor disposed in a slotted portion of a hopper casing, which includes an elongate and flat, stationary shutter having numerous equally spaced apertures and a movable shutter having numerous apertures capable of communicating with the apertures of the stationary shutter.

11 Claims, 6 Drawing Figures

DRY-PROCESS DEVELOPER REPLACING AND SUPPLYING DEVICE FOR ELECTROPHOTOGRAPHIC RECORDING APPARATUS

BACKGROUND OF THE INVENTION

1. Field of the Invention

The present invention relates to an electrophotographic recording apparatus of the type using a dry-process developing unit and, more particularly, to a device installed in a small-size, dry-process electrophotographic copier for replacing and supplying a single composition developer consisting of colored magnetic particles, or toner, or a dual composition developer which is a mixture of carrier and non-magnetic toner.

2. Discussion of the Background

In a dry-process developing unit of an electrophotographic copier, particularly one using the dual composition developer, the carrier of the developer undergoes fatigue after a long period of use and thereby losses the expected frictional charging effect. It is therefore necessary to replace the used developer, especially the carrier, with fresh developer from time to time. Heretofore, replacement of such a developer has exclusively been taken charge of by a serviceman and has required the steps of taking the developing unit out of the copier, removing the used developer by manipulating a special member or by bodily tilting the developing unit, and supplying a fresh developer into the empty developing unit. This not only causes the used and fresh developers to scattered but increases the service cost due to the awkward manual labor involved.

A prior art developing unit is known which includes at least two sections, i.e., a developing section and a developer supplying section, as disclosed in Japanese Patent Laid-Open Publication No. 56-114969/1981 by way of example. The developer supplying section is made up of a mechanism for mounting a toner cartridge, a toner agitating member, a toner supply roller and other various members. Therefore, the developing unit occupies a substantial portion of the space available in a copier and requires a large number of structural elements. Such is contradictory to the ever increasing demand for reduction in size and cost in the copier market.

SUMMARY OF THE INVENTION

It is therefore an object of the present invention to provide a developer replacing and supplying device for an electrophotographic recording apparatus which semiautomates the replacement and supply of a developer to promote user-oriented operation for such work.

It is another object of the present invention to provide a carrier replacing and supplying device which allows a carrier of a dual component dry-process developer to be readily replaced and supplied in an electrophotographic recording apparatus of the type using such a developer.

It is another object of the present invention to provide a developer replacing and supplying device which enables a developing unit to be designed for a small-size and cost-effective assembly needing no special member or space for the replacement.

It is another object of the present invention to provide a generally improved dry-process developer replacing and supplying device for an electrophotographic recording apparatus.

A developer replacing and supplying device for use with a developing unit of a type using a dual composition developer which is made up of toner and carrier of the present invention comprises, in combination, a developer discharge device for discharging a used developer from the developing unit, a carrier supply device for supplying fresh carrier to the developing unit, a toner supply device for supplying fresh toner to the developing unit, a support device for selectively and rotatably supporting the carrier supply device and the toner supply device, and an interceptor device for selectively intercepting the supply from one of either the toner supply device or the carrier supply device which is supported by the support means.

In accordance with the present invention, a developer replacing and supplying device for a small-size electrophotoraphic copier is disclosed which removes used developer from a developing unit and supplies fresh developer instead. After used developer which is a mixture of carrier and toner has been discharged, fresh carrier is introduced into the developing unit and, then, fresh toner to be mixed with the fresh carrier. The fresh carrier and the fresh toner are stored in physically independent cylindrical cartridges, which are selectively mounted in a cartridge casing. The cartridge casing is mounted in a hopper casing, which is provided integrally with the developing unit, and driven in a rotational motion together with the cartridge. The supply of the toner or the carrier from the associated cartridge into the developing unit is selectively intercepted by an interceptor disposed in a slotted portion of a hopper casing, which comprises an elongate and flat, stationary shutter having numerous equally spaced apertures and a movable shutter having numerous apertures capable of communicating with the apertures of the stationary shutter.

The above and other objects, features and advantages of the present invention will become more apparent from the following detailed description taken with the accompanying drawings.

DESCRIPTION OF THE PREFERRED EMBODIMENT

While the dry-process developer replacing and supplying device of the present invention is susceptible of numerous physical embodiments, depending upon the environment and requirements of use, a substantial number of the herein shown and described devices of the preferred embodiment have been made, tested and used, and all have performed in an eminently satisfactory manner.

Reference will be made to the accompanying drawings for describing in detail a developer replacing and supplying device embodying the present invention, particularly a device for replacing and supplying carrier included in a dual composition dry-process developer.

Figure 1:
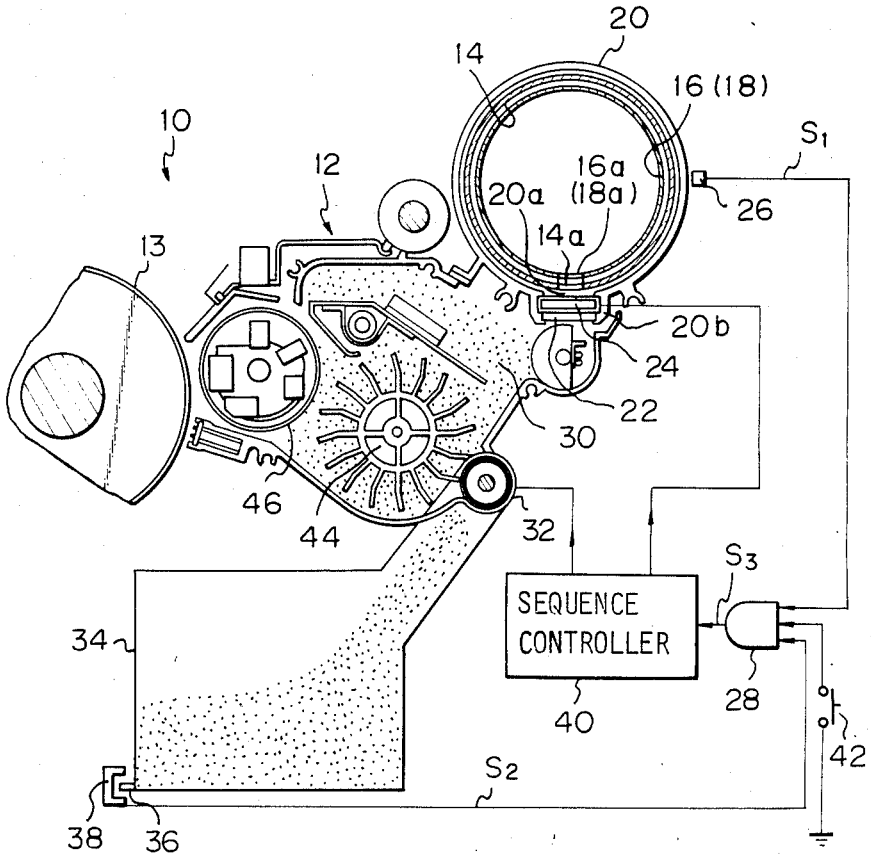
FIG. 1 is a section of an electrophotographic recording apparatus in which a developer replacing and supplying device embodying the present invention is installed.

Referring to FIG. 1, the device in accordance with the present invention is installed in all electrophotographic recording apparatus, generally 10, which comprises a dry-process developing unit 12, a photoconductive element 13, etc. Disposed in an upper right portion of the developing unit 12 is a hopper casing 20 which is constructed to allow a toner cartridge 16 or a carrier cartridge 18 accommodated in a cartridge casing 14 to be selectively inserted therein. An elongate slot 20*a* extends at the bottom of and along the length of the hopper casing 20. An elongate slot 14*a* extends through the cartridge casing 14, an elongate slot 16*a* through the toner cartridge 16, and an elongate slot 18*a* through the carrier casing 18, each in a position to align with the slot 20*a*.

The hopper casing 20 is provided with a guide frame 20*b* along its length and adjacent to the slot 20*a*, which communicates the hopper casing 20 to the developing unit 12. An elongate and flat, stationary shutter 22, which is formed with numerous apertures 22*a* at equal intervals as shown in FIGS. 2 and 3A–3C, is mounted in the frame 20*b*. A movable shutter 24 provided with a shape similar to that of the stationary shutter 22 and formed with numerous equally spaced apertures 24*a* is laid on the stationary shutter 22 and movable in a lengthwise reciprocal motion driven by a drive mechanism (not shown). The stationary shutter 22 and movable shutter 24 provide selective communication between the toner cartridge 16 or the carrier cartridge 18 and the developing unit 12.

A photosensor 26 is positioned in part of the hopper casing 20 in order to distinguish the toner cartridge 16 and the carrier cartridge 18 from each other based on a lug, a mark or like indication (not shown) provided on part of the outer periphery of the cartridge casing 14. The output $S_1$ of the photosensor 26 is applied to one input terminal of a decision gate 28, which may comprise an AND gate as illustrated.

A screw 32 for conveying developer 30 is located in a lower portion of the developing unit 12 and elongated to terminate at a bottle 34. The bottle 34 is removably mounted in a suitable predetermined position inside the apparatus 10 to collect the developer 30 therein. The bottle 34 is provided with a lug 36 or a mark or any other suitable kind of indication (not shown) in a part of its outer periphery, while a sensor 38 senses the lug 36 or like indication to see if the bottle 34 has been set in the predetermined collecting position. The output $S_2$ of the sensor 38 is applied to the other hand input terminal of the decision gate 28. The decision gate 28 produces an output $S_3$ which is routed to a sequence control circuit, or controller, 40. In response to the input $S_3$, the sequence controller 40 controls the conveyor screw 32 and movable shutter 24 according to a predetermined program such that the used developer 30 is removed first and, then, a fresh charge of developer is supplied. Designated by the reference numeral 42 is a switch for starting developer replacement, 44 an agitator, and 46 a developing roller.

Figure 2:
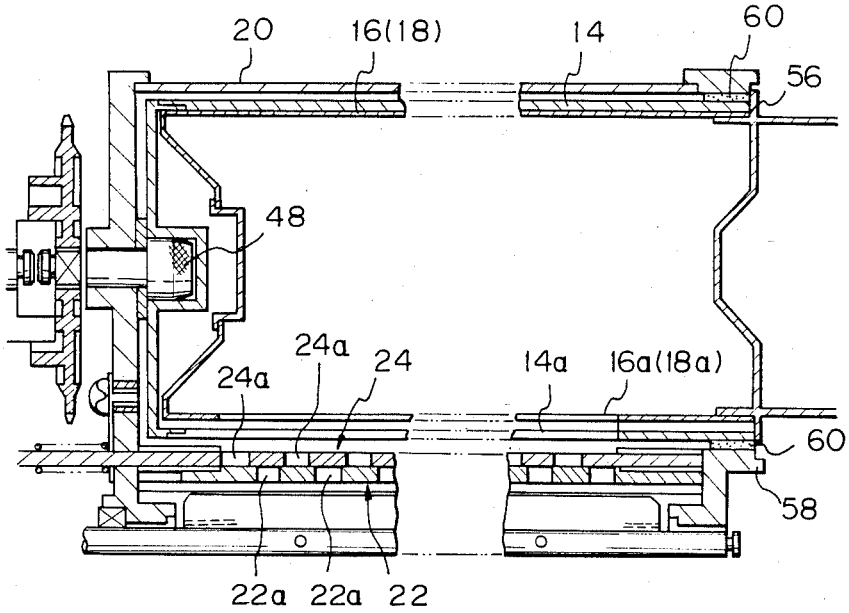
FIG. 2 is a fragmentary vertical section of the device shown in FIG. 1.
Figure 4:
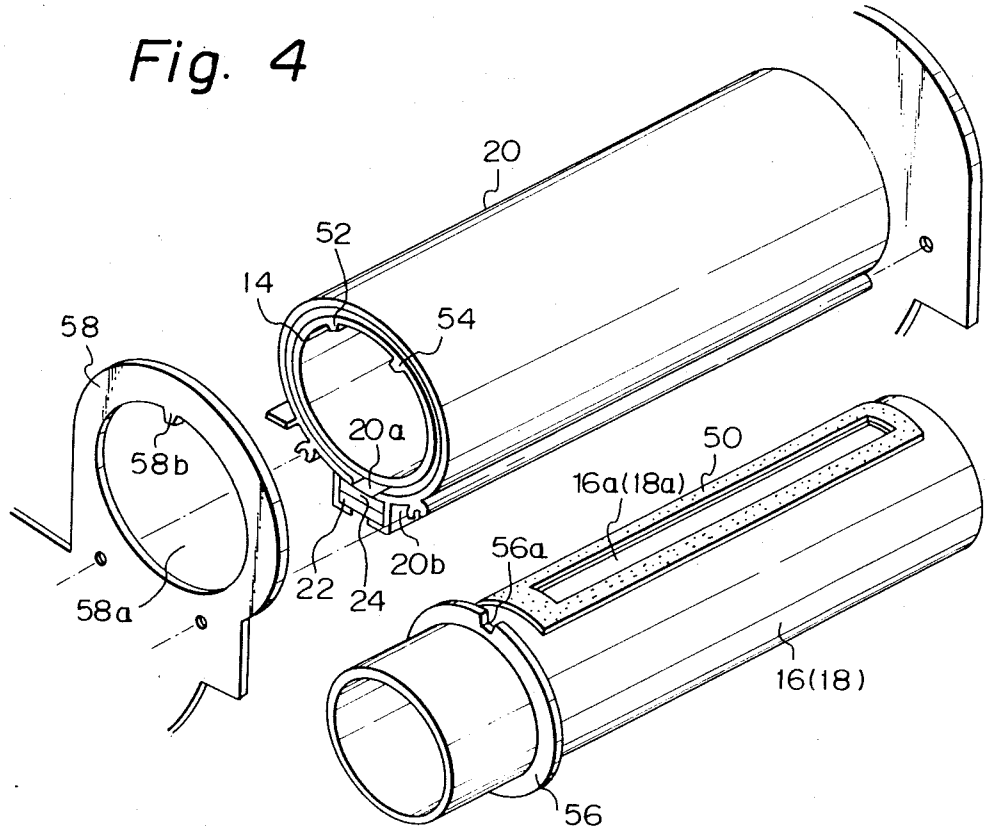
FIG. 4 is a perspective view of a toner cartridge or a carrier cartridge, a cartridge casing, and a hopper casing.

Referring to FIGS. 2 and 4, specific embodiments of the hopper casing 20, cartridge casing 14 and cartridge 16 (18) are shown. As shown in FIG. 2, the cartridge casing 14 is coupled with a drive shaft 48 which extends into the hopper casing 20, thereby being rotated inside the hopper casing 20 together with the toner cartridge 16 or the carrier cartridge 18. As shown in FIG. 4, a pair of spaced elongate lugs, or ridges, 52 and 54 extend on the inner surface of the cartridge casing 14 along and at opposite sides of the slot 14*a*. The lugs 52 and 54 are adapted to position and retain a packing member 50 which is fitted on each of the cartridges 16 and 18. Each cartridge 16 or 18 is provided with a radially outwardly extending flange 56 in a rear portion of its outer periphery with respect to an intended direction of insertion of the cartridge into the cartridge casing 14. The flange 56 includes a notch 56*a* in a position substantially aligned with the slot 16*a* (18*a*). Meanwhile, the hopper casing 20 includes an end plate 58 which is provided with an opening 58*a* and a lug 58*b* positioned in an upper portion of the opening 58*a*. In this construction, when the cartridge 16 (18) is to be inserted in the cartridge casing 14 through the end plate 58 of the hopper casing 20, the lug 58*b* of the end plate 58 obstructs the insertion unless the cartridge has its slot 16*a* (18*a*) facing upward. The reference numeral 60 in FIG. 2 designates a seal interposed between the hopper casing 20 and the cartridge casing 14 for the purpose of eliminating leakage of the toner or the carrier through bearings associated with the cartridge casing 14.

The operation for replacing the developer 30 in the developing unit 12 by means of the above-described device of the present invention will be explained. First, while keeping the movable shutter 24 closed, that is, while maintaining the apertures 22*a* and 24*a* out of alignment, one inserts the carrier cartridge 18 received in the cartridge casing 14 into the hopper casing 20 and places the bottle 34 in the predetermined position inside the apparatus 10. Then, the start button 42 is depressed for starting developer replacement. The sensor 26 associated with the hopper casing 20 senses the carrier cartridge 18 and the sensor 38 associated with the bottle mounting position senses the bottle 34. The output signals $S_1$ and $S_2$ of those sensors are delivered to the decision gate 28. In response to the signals $S_1$ and $S_2$, the decision gate 28 is enabled to apply its output $S_3$ to the sequence controller 40. Then, the sequence controller 40 produces an output to activate the screw 32 for discharging the used developer 30 from the developing unit 12 into the bottle 34 and, upon the lapse of a predetermined period of time long enough for causing the entire developer 30 in the unit 12 to be discharged, opens the movable shutter 24 so that a fresh carrier is fed into the unit 12 from the carrier cartridge 18.

After the supply of the fresh carrier into the developing unit 12, the carrier cartridge 18 is removed from the hopper casing 20 and, in turn, the toner cartridge 16 is inserted, followed by another start of the device. Then, the shutter 24 is opened again by an output signal of a toner density sensor (not shown), thereby supplying fresh toner from the cartridge 16 to the developing unit 12. The fresh toner is mixed with the previously supplied fresh carrier by the agitator 44 inside the unit 12 to fully condition the unit 12 for development. The toner and carrier mixture is supplied to the developing roller 46 and, thereby, to the surface of the photoconductive element 13.

The operation for loading the hopper casing 20 with the toner cartridge 16 or the carrier cartridge 18 and supplying the toner or the carrier therefrom to the developing unit 12 will now be described more specifically. Because the supply of the toner and that of the carrier are effected by substantially the same procedure, only the former will be discussed for simplicity. The operation starts with removing a seal (not shown) covering the slot 16*a* of the cartridge 16. Then, the cartridge 16 is inserted in the cartridge casing 14 with the slot 16*a* facing upward and with the packing 50 held between the lugs 52 and 54, whereby the notch 56*a* of the flange 56 is aligned with the lug 58*b* of the end plate 58 of the hopper casing 20 to allow the cartridge 16 to be completely positioned inside the cartridge casing 14. As the drive shaft 48 is rotated, the cartridge casing 14 coupled with the end of the drive shaft 48 is rotated together with the cartridge 16 with the result that the toner in the cartridge 16 is agitated and, every time the slot 16*a* aligns with the slot 20*a* of the hopper casing 20, is dropped into the slot 20*a*.

Figure 3A:
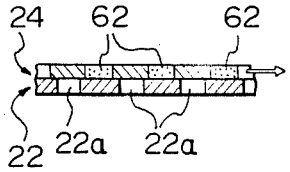
FIGS. 3A–3C are views of a stationary shutter and a movable shutter of FIGS. 1 and 2 which are shown in different relative positions.
Figure 3B:
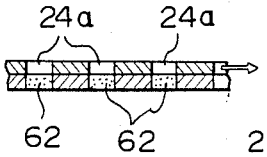
Figure 3C:
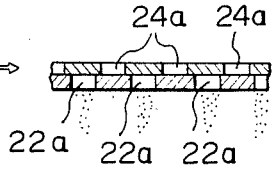

The movable shutter 24, located in the slot 20*a* and reciprocating along its length in unison with the above-stated operation, receives the toner 62 discharged into the slot 20*a* in its apertures 24*a* as shown in FIG. 3A and, every time the apertures 24*a* align with those 22*a* of the stationary shutter 22 as shown in FIG. 3B, releases it into the developing unit 12 for a predetermined amount at a time as shown in FIG. 3C. In accordance with the illustrative embodiment, an arrangement is made such that at the time when the slots 16*a* and 14*a* of the cartridge 16 and cartridge casing 14 are aligned with the slot 20*a* of the hopper casing 20, the apertures 22*a* and 24*a* of the shutters 22 and 24 are prevented from communicating with each other, thereby preventing a large quantity of toner from being fed into the unit 12 at any given time. Such is accomplished by use of a position sensor.

In summary, it will be seen that the present invention provides a dry-process developer replacing and supplying device for an electrophotographic copier which allows a used developer in a developing unit to be replaced with fresh developer by a semiautomated procedure and, thereby, allows a user, instead of a serviceman, to accomplish such operation easily and cleanly, offering a remarkable cut-down in service cost. This advantage is derived from a unique construction which, due to provision of used developer discharge means in the developing unit and hopper means located above the developing unit for selectively receiving a toner cartridge and a carrier cartridge, requires one to simply activate the dicharge means and load the hopper means with the toner cartridge or the carrier cartridge. In addition, the device of the present invention enhances a small-size and low cost design of a developing unit because the supply of toner and that of carrier share the same hopper means and, therefore, there is no need for a special member or space for the replacement.

While the present invention has been shown and described in relation with a dual composition developer which consists of toner and carrier, it is naturally applicable even to a single composition developer consisting of toner only.

Various modifications will become possible for those skilled in the art after receiving the teachings of the present disclosure without departing from the scope thereof.

What is claimed as new and desired to be secured by Letters Patent of the United States is:

1. A developer replacing and supplying device for use with a developing unit of a type using a dual composition developer which is made up of toner and carrier, comprising:

developer discharge means for discharging a used developer from a developing unit and which includes a bottle placed in a predetermined position adjacent said developing unit and in communication with a developer output for collecting the discharged developer;

carrier supply means for supplying fresh carrier to the developing unit;

toner suppy means for supplying fresh toner to the developing unit;

support means for selectively and rotatably supporting said carrier supply means and toner supply means, said support means having a slot formed therein;

interceptor means for selectively intercepting the supply from one of the toner supply means and the carrier supply means which is supported by said support means; and control means for controlling the developer discharge means, the support means and the interceptor means such that the developer discharge means discharges the used developer from the developing unit and such that the interceptor means subsequently discontinues interception of the supply of the toner or the carrier to the developing unit wherein the control means further comprises a shutter for opening and closing said slot of said support means so as to communicate and to discontinue communication of an interior of at least one of said supply means to and from an interior portion of the developing unit, a supply means sensor for identifying said carrier supply means or said toner supply means, and a bottle sensor in the developing unit and wherein said interceptor means discontinues interception of the supply from either of said supply means and said discharge means discontinues discharge of said used developer upon said sensors detecting the absence of either of said supply means and/or said bottle.

2. A developer replacing and supplying device as claimed in claim 1, wherein said developer discharge means further comprises a conveyor screw mounted in said developer outlet.

3. A developer replacing and supplying device as claimed in claim 1, wherein said carrier supply means further comprises a carrrier cartridge which is provided with an elongate slot, and wherein the toner supply means further comprises a toner cartridge which is provided with an elongate slot.

4. A developer replacing and supplying device as claimed in claim 3, wherein said support means further comprises cartridge casing means disposed in an upper portion of said developing unit for receiving one of the toner cartridge and carrier cartridge to rotate integrally therewith, wherein said slot comprises an elongate slot which aligns with the slot of the toner cartridge or the slot of the carrier cartridge.

5. A developer replacing and supplying device as claimed in claim 4, wherein said support means further comprises hopper casing means for rotatably accommodating said cartridge casing means and formed integrally with the developing unit, said hopper casing means being provided with an elongate slot which is aligned with said slot of said cartridge casing means.

6. A developer replacing and supplying device as claimed in claim 5, wherein said interceptor means further comprises shutter means located in the vicinity of said slot of said hopper casing means.

7. A developer replacing and supplying device as claimed in claim 6, wherein said interceptor means further comprises an elongate and flat, stationary shutter provided with a number of equally spaced apertures along the slot of said hopper casing, and an elongate and flat, movable shutter movable in a reciprocal motion along a length of the slot of the hopper casing and which is provided with a number of apertures which align with said apertures of said stationary shutter.

8. A developer replacing and supplying device as claimed in claim 1, wherein said developer discharge means further comprises a conveyor screw mounted in said developer outlet and further comprising drive means for driving the conveyor screw and said shutter in response to an output of said supply means sensor and an output of said bottle sensor.

9. A developer replacing and supplying device as claimed in claim 8, wherein said drive means further comprises decision gate means supplied with said outputs of said cartridge sensor and said bottle sensor, and a sequence control circuit for controlling the conveyor screw and shutter in response to an output of said decision gate means such that in accordance with a predetermined program said conveyor screw is activated to discharge said developer from said developing unit into said bottle and, upon a lapse of a predetermined period of time which causes the entire developer to be discharged, the shutter is opened to supply the carrier in the carrier supply means received in the cartridge casing into the developing unit and wherein the carrier supply means is then replaced with the toner supply means to supply the toner into the developing unit.

10. A developer replacing and supplying device as claimed in claim 9, wherein said drive means further comprises a switch electrically connected to said decision gate means for starting a developer replacing operation.

11. A developer replacing and supplying device as claimed in claim 10, wherein said decision gate means further comprises an AND gate.

* * * * *